US005199406A

United States Patent [19]

Taruya et al.

[11] Patent Number: 5,199,406

[45] Date of Patent: Apr. 6, 1993

[54] IGNITER FOR AN INTERNAL COMBUSTION ENGINE

[75] Inventors: Masaaki Taruya; Mitsuru Koiwa, both of Himeji, Japan

[73] Assignee: Mitsubishi Denki Kabushiki Kaisha, Tokyo, Japan

[21] Appl. No.: 878,667

[22] Filed: May 5, 1992

[30] Foreign Application Priority Data

May 7, 1991 [JP] Japan ..... 3-101083

[51] Int. Cl.[5] ..... F02P 3/05

[52] U.S. Cl. ..... 123/644

[58] Field of Search ..... 123/609, 610, 611, 644, 123/647, 651; 361/400, 401, 402

[56] References Cited

U.S. PATENT DOCUMENTS 4,111,174 9/1978 Fitzner et al. ..... 123/602
4,538,585 9/1985 Arguello et al. ..... 123/644 X
4,539,622 9/1985 Akasaki ..... 361/402 X
4,750,467 6/1988 Neuhalfen ..... 123/644
5,113,840 5/1992 Taruya et al. ..... 123/644

*Primary Examiner*—Tony M. Argenbright
*Attorney, Agent, or Firm*—Sughrue, Mion, Zinn, Macpeak and Seas

[57] ABSTRACT

An igniter for an internal combustion engine comprising a power transistor (4), a current regulating circuit (7) and a current detection resistor (12) connected between the power transistor (4) and the ground for detecting the current flowing through an ignition coil. The current detection resistor (12) is trimmed to provide a controlled resistance between the power transistor (4) and the ground. The current detection resistor (12) may be disposed within or outside the mold resin package (10) for hermetically sealing the power transistor (4) and the current regulating circuit (7).

3 Claims, 2 Drawing Sheets

IGNITER FOR AN INTERNAL COMBUSTION ENGINE

BACKGROUND OF THE INVENTION

This invention relates to an engine ignition apparatus and more particularly to an igniter for an internal combustion engine.

FIG. 3 is a circuit diagram illustrating one example of an ignition system for an internal combustion engine. In FIG. 3, reference numeral 1 designates a battery, 2 is a driving transistor connected to the battery 1 through a resistor 3, 4 is a power transistor connected in Darlington connection and driven by an output from the driving transistor 3, 5 is an ignition coil having a primary coil 5*a* connected between the battery 1 and the collector of the power transistor 4 and a secondary coil 5*b* connected to a distributor (not shown) which in turn is connected to ignition plugs, 6 is a current detection resistor connected between the emitter of the power transistor 4 and the ground for detecting a current flowing through the primary coil 5*a* of the ignition coil 5, and 7 is a current regulating circuit for regulating a base current of the power transistor 4 in response to a voltage generated across the current detection resistor 6 so that the current flowing through the primary coil 5*a* of the ignition coil 5 is controlled.

When the drive transistor 2 is turned off by an external signal, the power transistor 4 turns on to allow an electric current to flow through the primary coil 5*a* of the ignition coil 5, and when the power transistor 4 turns off, a high voltage generated in on the secondary coil 5*b* of the ignition coil 5 and is supplied to the ignition plug through the distributor (not shown) to ignite the engine. During this operation, a voltage generated across the resistor 6 due to the current flowing through the primary coil 5*a* of the ignition coil 5 is supplied to the current regulating circuit 7 which controls the base current of the power transistor 4 in accordance with this voltage to regulate the current flowing through the primary coil 5*a* of the ignition coil 5 to a predetermined constant value.

FIG. 4 is a schematic plan view illustrating an IC package structure of a known igniter in which the power transistor 4, the current detection resistor 6 and the current regulating circuit 7 electrically connected by conductor wires 12 and 13 are hermetically sealed with a mold resin package 10. The IC package is manufactured by first providing the power transistor 4 and the current regulating circuit 7 on lead frame 11. Then, power transistor 4 and the current regulating circuit 7 are connected by an electrically conductive wire 12 which functions as a current detection portion or a current detection resistor 6, and the power transistor 4, the current regulating circuit 7 are connected to the lead frame 11 by similar conductive wires 13. Then, the above components are hermetically sealed by the mold resin package 10 by the transfer molding.

In the known arrangement illustrated and described in conjunction with FIG. 4, the current detection resistance 6 is provided by means of the resistance of the conductive wire 12 bonded to the power transistor 4 and the current regulating circuit 7 to connect them. Accordingly, the length and the thickness of the conductive wire 12 may vary from one conductive wire to another and the contacting resistance at the bonding connections may be different for each conductive wire, so that the current-regulation value for the current flowing through the primary coil 5*a* of the ignition coil 5 varies from one igniter to another. If the primary current exceeds the rated current of the power transistor 4 due to a large current, a power transistor which has a large current capacity and which therefore is expensive must be used, and if the primary current is smaller than the predetermined value, the secondary voltage generated at the secondary coil 5*b* of the ignition coil 5 is not high enough to generate massive sparks.

SUMMARY OF THE INVENTION

Accordingly, the chief object of the present invention is to provide an igniter for an internal combustion engine free from the above-discussed problems of the known igniter arrangement.

Another object of the present invention is to provide an igniter in which the deviation of the current regulating value for the current flowing through the primary coil of the ignition coil is reduced to improve the yield.

With the above objects in view, the igniter for an internal combustion engine of the present invention comprises a power transistor for interrupting an electric current flowing through a primary coil of an ignition coil. A current detection resistor is connected between the power transistor and the ground for detecting the current flowing through the primary coil, and the current detection resistor has a resistance trimmed to provide a controlled resistance between the power transistor and the ground. The igniter also comprises a current regulating circuit for regulating the current flowing through the primary coil in response to an output from the current detection resistor, and a mold resin package for hermetically sealing therein the power transistor and the current regulating circuit. The current detection resistor may be disposed within or outside of the mold resin package.

BRIEF DESCRIPTION OF THE DRAWINGS

The present invention will become more readily apparent from the detailed description of the preferred embodiments of the present invention taken in conjunction with the accompanying drawings, in which.

DESCRIPTION OF THE PREFERRED EMBODIMENTS

Figure 1:
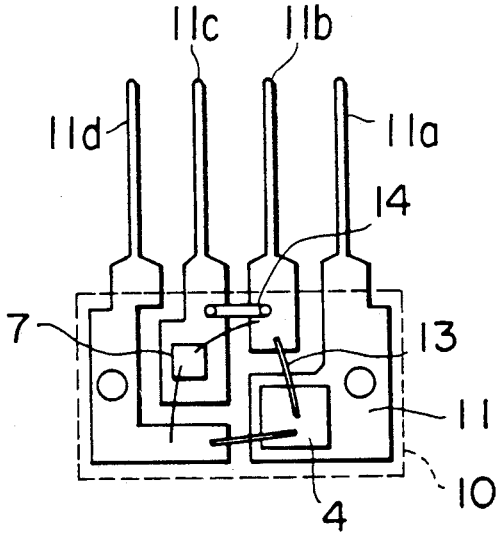
FIG. 1 is a schematic plan view illustrating one embodiment of the igniter of the present invention.

FIG. 1 illustrates one embodiment of the igniter of the present invention, in which the igniter for an internal combustion engine comprises a power transistor 4 for interrupting an electric current flowing through a primary coil of an ignition coil 5. The power transistor 4 is mounted on a conductor pattern terminal 11*a* of the lead frame 11 and electrically connected to second conductor pattern terminal 11*b* through a conductive wire 13. The igniter includes a third conductor pattern 11*c* and a fourth conductor pattern 11*d*.

A current regulating circuit 7, which is for regulating the current flowing through the primary coil 5*a* of the ignition coil 5 in response to an output from a current detection resistor 14, is mounted on the third conductor pattern terminal 11*c*. The current regulating circuit 7 is connected by similar conductors 13 to the second and fourth conductor pattern terminals 11*b* and 11*d*.

The current detection resistor 14 is connected between the power transistor 4 and the ground through the second conductor pattern terminal 11*b* and the third conductor pattern terminal 11*c*. According to the present invention, the current detection resistor 14 has a resistance value trimmed to provide a controlled resistance between the power transistor 4 and the ground so that no deviation occurs in each ignition system. This trimming of the resistance value can be achieved before being connected in to the circuit, so that the resistance value of the current detection resistor 14 can be precisely controlled.

A mold resin package 10 is formed by transfer molding mold resin around the electronic components for hermetically sealing therein the power transistor 4, the current regulating circuit 7, the inner parts of the conductive pattern terminals 11*a* to 11*d*, bonding wires 13 and the current detection resistor 14. Outer parts of the conductive pattern terminals 11*a* to 11*d* extending outwardly of the mold resin package 10 constitute four terminals for external connections.

With this embodiment, since the current detection resistor 14 accurately trimmed in terms of its resistance value before packaged is used in the igniter circuit, the deviation in the current flowing through the primary coil 5*a* of the ignition coil 5 is reduced, so that a sufficiently large primary current is reliably obtained without the need for using circuit components of unnecessarily high ratings.

Figure 2:
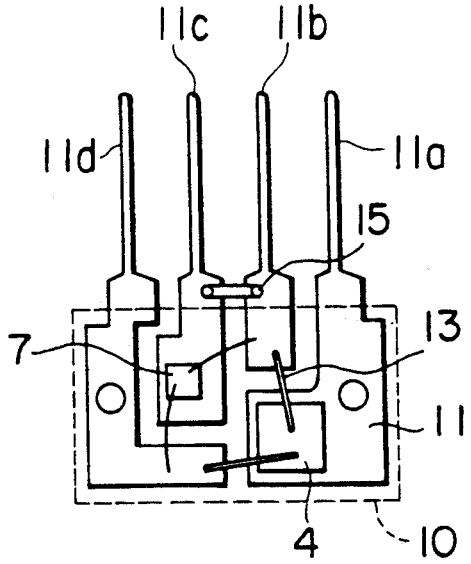
FIG. 2 is a schematic plan view illustrating another embodiment of the igniter of the present invention.
Figure 3:
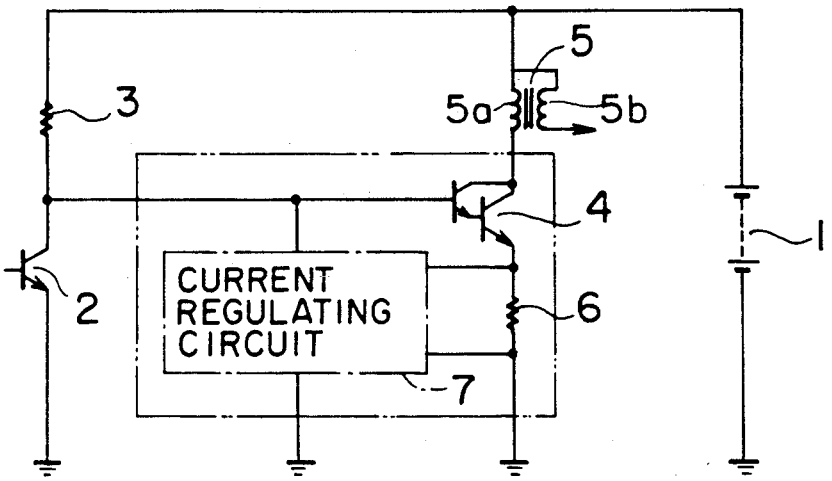
FIG. 3 is a circuit diagram illustrating a circuit of an ignition system of the known type.
Figure 4:
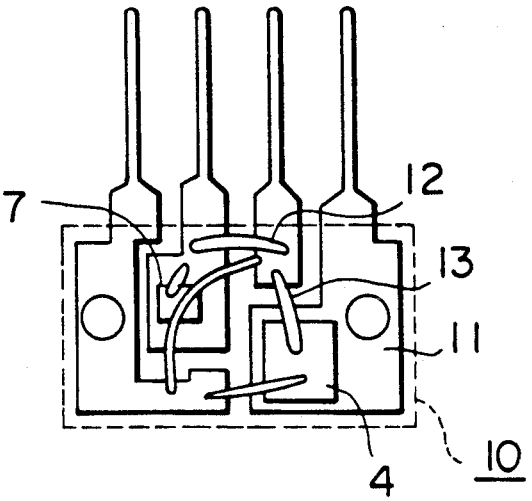
FIG. 4 PRIOR ART
FIG. 4 is a schematic plan view of a known igniter.

FIG. 2 illustrates another embodiment of the igniter of the present invention, wherein the only structural difference of this embodiment as compared to that illustrated in FIG. 1 is that the current detection resistor 15 shown in FIG. 2 is disposed outside of the mold resin package 10 and that the current detection resistor 15 is of the type of which resistance value can be trimmed. Therefore, the resistance value of the current detection resistor 15 can be precisely trimmed while keeping the ignition circuit operated to control the deviation of the primary current in the ignition coil 5 which is regulated in accordance with the voltage generated across the current detection resistor 15.

What is claimed is:

1. An igniter for an internal combustion engine, comprising:

a power transistor for interrupting an electric current flowing through a primary coil of an ignition coil;

a current detection resistor connected between said power transistor and the ground for detecting the current flowing through the primary coil, said current detection resistor having a resistance trimmed to provide a controlled resistance between said power transistor and the ground;

a current regulating circuit for regulating the current flowing through the primary coil in response to an output from said current detection resistor; and a mold resin package for hermetically sealing therein said power transistor and said current regulating circuit.

2. An igniter as claimed in claim 1, wherein said current detection resistor is disposed within said mold resin package.

3. An igniter as claimed in claim 1, wherein said current detection resistor is disposed outside of said mold resin package.

* * * * *